US009595221B2

(12) United States Patent
Hamer et al.

(10) Patent No.: US 9,595,221 B2
(45) Date of Patent: Mar. 14, 2017

(54) OLED DISPLAY WITH REDUCED POWER CONSUMPTION

(71) Applicant: Global OLED Technology LLC, Herndon, VA (US)

(72) Inventors: John W. Hamer, Rochester, NY (US); Michael E. Miller, Xenia, OH (US); John Ludwicki, Churchville, NY (US)

(73) Assignee: Global OLED Technology LLC, Herndon, VA (US)

( * ) Notice: Subject to any disclaimer, the term of this patent is extended or adjusted under 35 U.S.C. 154(b) by 0 days.

(21) Appl. No.: 15/133,554

(22) Filed: Apr. 20, 2016

(65) Prior Publication Data

US 2016/0247444 A1 Aug. 25, 2016

Related U.S. Application Data

(63) Continuation of application No. 13/897,893, filed on May 20, 2013, now Pat. No. 8,347,647, which is a (Continued)

(51) Int. Cl.

| | |
|---|---|
| ***G09G 3/32*** | (2016.01) |
| ***G09G 3/20*** | (2006.01) |
| ***G09G 3/36*** | (2006.01) |
| ***F21V 9/08*** | (2006.01) |
| *G09G 3/30* | (2006.01) |

(52) U.S. Cl.

CPC ..... *G09G 3/3208* (2013.01); *F21V 9/08* (2013.01); *G09G 3/2003* (2013.01); *G09G 3/3216* (2013.01); *G09G 3/3225* (2013.01); *G09G 3/3607* (2013.01); *G09G 3/30* (2013.01); *G09G 2300/0443* (2013.01); *G09G 2300/0452* (2013.01); *G09G 2320/0666* (2013.01); *G09G 2330/021* (2013.01); *G09G 2340/06* (2013.01)

(58) Field of Classification Search

CPC ... G09G 2300/0452; G09G 2300/0666; G09G 2300/0443; G09G 3/2003; G09G 3/3208; G09G 3/30; G09G 3/3607; G09G 3/3225; G09G 3/3216; G09G 2330/021; G09G 2320/0626; G09G 2320/0233; G09G 2320/0242; G09G 2340/06; H01L 27/3213; H01L 27/322; H01L 51/5012; Y10S 428/917; F21V 9/08

USPC ..... 345/76–83

See application file for complete search history.

(56) References Cited

U.S. PATENT DOCUMENTS

| | | | | |
|---|---|---|---|---|
| 2004/0000864 | A1* | 1/2004 | Kato | H01L 27/322 313/504 |
| 2007/0176862 | A1* | 8/2007 | Kurt | G09G 3/2092 345/82 |
| 2010/0289727 | A1* | 11/2010 | Miller | G09G 3/2003 345/76 |

* cited by examiner

*Primary Examiner* — Stephen Sherman

(74) *Attorney, Agent, or Firm* — Global OLED Technology LLC

(57) ABSTRACT

An OLED display with a plurality of pixels for displaying an image having a target display white point luminance and chromaticity, each pixel including three red, green and blue gamut-defining emitters defining a display gamut and a magenta emitter with two of cyan, yellow or white emitters as three additional emitters which emit light within the display gamut; the display including a means for receiving a three-component input image signal; transforming the three-component input image signal to a six component drive signal; and providing the drive signal to display an image corresponding to the input image signal. One embodiment is where the pixels have red, green, blue, cyan, magenta and yellow colored subpixels.

4 Claims, 12 Drawing Sheets

Related U.S. Application Data continuation of application No. 13/032,074, filed on Feb. 22, 2011, now Pat. No. 8,466,856.

OLED DISPLAY WITH REDUCED POWER CONSUMPTION

CROSS REFERENCE TO RELATED APPLICATIONS

This application is a continuation of U.S. patent application Ser. No. 13/897,893, filed May 20, 2013 entitled "OLED DISPLAY WITH REDUCED POWER CONSUMPTION" by John W. Hamer, Michael E. Miller and John Ludwicki, which is a continuation of U.S. patent application Ser. No. 13/032,074, filed Feb. 22, 2011 entitled "OLED DISPLAY WITH REDUCED POWER CONSUMPTION" by John W. Hamer, Michael E. Miller and John Ludwicki.

Reference is also made to commonly assigned U.S. patent application Ser. No. 12/464,123, issued as U.S. Pat. No. 8,237,633; commonly assigned U.S. patent application Ser. No. 12/174,085, issued as U.S. Pat. No. 8,169,389; and commonly assigned co-pending U.S. patent application Ser. No. 12/397,500, filed Mar. 4, 2009 entitled "FOUR-CHANNEL DISPLAY POWER REDUCTION WITH DESATURATION" by Miller et al; the disclosures of which are incorporated herein by reference.

FIELD OF THE INVENTION

The present invention relates to OLED devices, and in particular white OLED devices and a method for reducing the overall power requirements of the devices.

BACKGROUND OF THE INVENTION

An organic light-emitting diode device, also called an OLED, commonly includes an anode, a cathode, and an organic electroluminescent (EL) unit sandwiched between the anode and the cathode. The organic EL unit includes at least a hole-transporting layer (HTL), a light-emitting layer (LEL), and an electron-transporting layer (ETL). OLEDs are attractive because of their low drive voltage, high luminance, wide viewing-angle, and capability for full color displays and for other applications. Tang et al. described this multilayer OLED in their U.S. Pat. Nos. 4,769,292 and 4,885,211.

OLEDs can emit different colors, such as red, green, blue, or white, depending on the emitting property of its LEL. An OLED with separate red-, green-, and blue-emitting pixels (RGB OLED) can produce a wide range of colors and is also called a full-color OLED. Recently, there is an increasing demand for broadband OLEDs to be incorporated into various applications, such as a solid-state lighting source, color display, or a full color display. By broadband emission, it is meant that an OLED emits sufficiently broadband light throughout the visible spectrum so that such light can be used in conjunction with filters or color change modules to produce displays with at least two different colors or a full color display. In particular, there is a need for broadband-light-emitting OLEDs (or broadband OLEDs) where there is substantial emission in the red, green, and blue portions of the spectrum, i.e., a white-light-emitting OLED (white OLED). The use of white OLEDs with color filters provides a simpler manufacturing process than an OLED having separately patterned red, green, and blue emitters. This can result in higher throughput, increased yield, and cost savings in manufacturing. White OLEDs have been reported, e.g. by Kido et al. in Applied Physics Letters, 64, 815 (1994), J. Shi et al. in U.S. Pat. No. 5,683,823, Sato et al. in JP 07-142169, Deshpande et al. in Applied Physics Letters, 75, 888 (1999), and Tokito, et al. in Applied Physics Letters, 83, 2459 (2003).

However, in contrast to the manufacturing improvements achievable by white OLEDs in comparison to RGB OLEDs, white OLEDs suffer efficiency losses in actual use. This is because each subpixel produces broadband, or white, light, but color filters remove a significant part of it. For example, in a red subpixel as seen by an observer, an ideal red color filter would remove blue and green light produced by the white emitter, and permit only red to pass. A similar loss is seen in green and blue subpixels. The use for color filters, therefore reduces the radiant efficiency to approximately ⅓ of the radiant efficiency of the white OLED. Further, available color filters are often far from ideal, having peak transmissivity significantly less than 100%, with the green and blue color filters often having peak transmissivity below 80%. Finally, to provide a display with a high color gamut, the color filters often need to be narrow bandpass filters and therefore they further reduce the radiant efficiency. In some systems, it is possible for the radiant efficiencies of the resulting red, green, and blue subpixels to have radiant efficiencies on the order of one sixth of the radiant efficiency of the white emitter.

Several methods have been discussed for increasing the efficiency of OLED displays using a white emitter. For example, Miller et al. in U.S. Pat. No. 7,075,242, entitled "Color OLED display system having improved performance" discuss the application of an unfiltered white subpixel to increase the efficiency of such a display. Other disclosures, including Cok et al. in U.S. Pat. No. 7,091,523, entitled "Color OLED device having improved performance" and Miller et al. in U.S. Pat. No. 7,333,080 entitled "Color OLED display with improved power efficiency" have discussed the application of yellow or cyan emitters for improving the efficiency of light emission for a display employing a white emitter.

Other references that describe displays that use multiple primaries include U.S. Pat. No. 7,787,702, US 20070176862; US 20070236135 and US 20080158097.

While these methods improve the efficiency of the resulting display, the improvement is often less than desired for many applications.

SUMMARY OF THE INVENTION

According to a first aspect of the present invention, an OLED display with reduced power consumption includes a plurality of pixels, each pixel including:

i) a white-light emitting layer;

ii) red, green and blue color filters for transmitting light corresponding to red, green and blue gamut-defining emitters, each emitter having respective chromaticity coordinates, wherein the chromaticity coordinates of the red, green and blue emitters together define a display gamut;

iii) a magenta color filter and two of cyan, yellow or no color filters for filtering light corresponding to magenta and correspondingly two of cyan, yellow or white additional within-gamut emitters having chromaticity coordinates within the display gamut, wherein the magenta and two of the cyan, yellow or white emitters form an additional color gamut, each additional emitter has a corresponding radiant efficiency, and wherein the radiant efficiency of each additional emitter is greater than the radiant efficiency of each of the gamut-defining emitters;

iv) the red, green, blue, magenta and an additional two of the cyan, yellow or white emitters are six subpixels of a single pixel; and comprising:

a. means to receive a three-component input image signal;

b. transforming the three-component input image signal to a six-component drive signal; and c. providing the six components of the drive signal to respective emitters of the OLED display to display an image corresponding to the input image signal whereby there is a reduction in power.

It is an advantage of the first aspect of this invention that a three-component input image signal can be converted to a five or more component drive signal to provide a display with a higher display white point luminance for the preponderance of images while maintaining color saturation for images having bright, highly saturated colors. It is an advantage of the second aspect of this invention that it can reduce the power consumption for a white OLED display, and can increase display lifetime. It is a further advantage of this invention that the reduced power consumption can reduce heat generation, and can eliminate the need for heat sinks presently required in some OLED displays of this type.

DETAILED DESCRIPTION OF THE INVENTION

Figure 1:
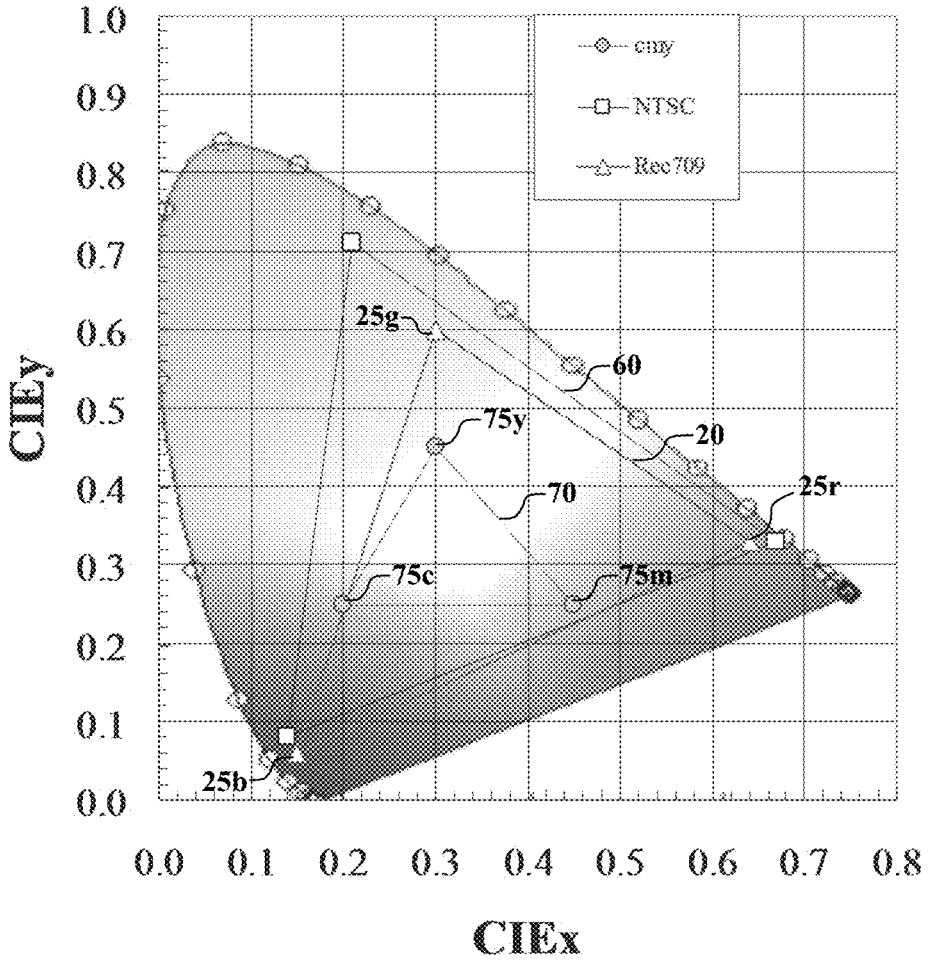
FIG. 1 shows some color gamuts in a 1931 CIE color diagram.

The term "OLED device" is used in its art-recognized meaning of a display device comprising organic light-emitting diodes as pixels or subpixels. It can mean a device having a single pixel or subpixel. Each light-emitting unit includes at least a hole-transporting layer, a light-emitting layer, and an electron-transporting layer. Multiple light-emitting units can be separated by intermediate connectors. The term "OLED display" as used herein means an OLED device comprising a plurality of subpixels which can be of different colors. A color OLED device emits light of at least one color. The term "multicolor" is employed to describe a display panel that is capable of emitting light of a different hue in different areas. In particular, it is employed to describe a display panel that is capable of displaying images of different colors. These areas are not necessarily contiguous. The term "full color" is employed to describe multicolor display panels that are capable of emitting in the red, green, and blue regions of the visible spectrum and displaying images in any combination of hues. The red, green, and blue colors constitute the three primary colors from which the other colors producible by the display can be generated by appropriate mixing. The term "hue" is the degree to which a color can be described as similar to or different from red, green, blue and yellow (the unique hues). Each subpixel or combination of subpixels has an intensity profile of light emission within the visible spectrum, which determines the perceived hue, chromaticity and luminance of the subpixel or combination of subpixels. The term "pixel" is employed to designate a minimum area of a display panel that includes a repeating array of subpixels and can display the full gamut of display colors. In full color systems, pixels comprise individually controllable subpixels of different colors, typically including at least subpixels for emitting red, green, and blue light.

In accordance with this disclosure, broadband emission is light that has significant components in multiple portions of the visible spectrum, for example, blue and green. Broadband emission can also include the situation where light is emitted in the red, green, and blue portions of the spectrum in order to produce white light. White light is that light that is perceived by a user as having a white color, or light that has an emission spectrum sufficient to be used in combination with color filters to produce a practical full color display. For low power consumption, it is often advantageous for the chromaticity of the white-light-emitting OLED to be targeted close to a point on the Planckian Locus and preferably close to a standard CIE daylight illuminance, for example, CIE Standard Illuminant D65, i.e. 1931 CIE chromaticity coordinates of CIE x=0.31 and CIE y=0.33. This is particularly the case for so-called RGBW displays having red, green, blue, and white subpixels. Although CIE x, CIE y coordinates of about 0.31, 0.33 are ideal in some circumstances, the actual coordinates can vary significantly and still be very useful. It is often desirable for the chromaticity coordinates to be "near" (i.e., within a distance of 0.1 CIE x,y units) the Planckian Locus. The term "white-light emitting" as used herein refers to a device that produces white light internally, even though part of such light can be removed by color filters before viewing.

Turning now to FIG. 1, there is shown a graph of several color gamuts in a 1931 CIE chromaticity diagram. The largest triangle is a display gamut representing the NTSC standard color gamut 60. The intermediate triangle is a display gamut according to a defined HDTV standard (Rec. ITU-R BT.709-5 2002, "Parameter values for the HDTV standards for production and international programme exchange," item 1.2, herein referred to as Rec. 709). The triangle will be referred to as Rec. 709 color gamut 20. This display gamut is created by chromaticity coordinates of a red gamut-defining emitter 25*r* at CIE x,y coordinates of 0.64, 0.33, chromaticity coordinates of a green gamut-defining emitter 25*g* at coordinates 0.30, 0.60, and a chromaticity coordinates of blue gamut-defining emitter 25*b* at coordinates 0.15, 0.06. It will be understood that other display gamuts can be used in the method of this invention. For this invention, the term "gamut-defining emitter" will be used to mean an emitter that provides light of a predetermined color that cannot be formed by combining light from other emitters within the display. Further, light from any "gamut defining emitter" can be combined with light from other gamut-defining emitters to produce a gamut of colors, including colors within the gamut. Red, green, and blue emitters are typical gamut-defining emitters, which form a gamut with a triangular shape within chromaticity space. One method of producing gamut-defining emitters such as these is to use a white-light emitting source (e.g. a white OLED) with red, green, and blue color filters. However, as described above, this means that each gamut-defining emitter is inefficient in terms of the power converted to usable light, and as a result, the entire display is inefficient.

One embodiment of a method according to the present invention for displaying an image on an OLED display with higher efficiency, and therefore with reduced power consumption includes three gamut-defining emitters and three additional emitters. In one example, the OLED display includes three gamut-defining emitters having chromaticity coordinates corresponding to the primaries of the Rec 709 gamut and three additional emitters having chromaticity coordinates within the gamut defined by the chromaticity coordinates of the primaries. In this example, the three corners of the smallest triangle are the chromaticity coordinates of three additional emitters, and these form an additional color gamut 70. These three additional emitters include a cyan within-gamut emitter having chromaticity coordinates 75*c*, a magenta within-gamut emitter having chromaticity coordinates 75*m*, and a yellow within-gamut emitter having chromaticity coordinates 75*y*. Additional color gamut 70 is significantly smaller than the color gamut defined by the chromaticity coordinates of the three gamut-defining emitters, i.e., the full Rec. 709 color gamut 20. Each of the six emitters has a corresponding radiant efficiency. Within the current invention, radiant efficiency is defined as the ratio of the energy that is propagated from the display or an individual emitter in the form of electromagnetic waves within a wavelength range of 380 to 740 nm to the electrical energy input to the display or an individual emitter. This definition limits radiant efficiency to include only energy that is emitted from the display or individual emitter and that can be perceived by the human visual system since the human visual system is only sensitive to wavelengths of 380 to 740 nm.

In one embodiment, the red, green, and blue emitters, which are the gamut-defining emitters, have average radiant efficiencies of no more than one-third of the total each, as the wavelengths of light transmitted by the red, green, and blue emitters have little or no overlap. The radiant efficiency of the additional emitters is greater than the radiant efficiency of each of the gamut-defining emitters. For example, consider the additional magenta emitter with CIE x,y coordinates of 0.45, 0.25 having chromaticity coordinates 75*m* in additional color gamut 70 and which can be formed with the white emitter and a magenta filter. A magenta filter will remove green light and let red and blue light pass. Thus, the radiant efficiency of a magenta emitter can be at least as high as ⅔ as the filter removes only one of the primary components of the light emission. Similarly, the additional emitter with CIE x,y coordinates of 0.30, 0.45 is a yellow emitter having chromaticity coordinates 75*y* (blue light is filtered while red and green light passes) and the additional emitter with CIE x,y coordinates of 0.20, 0.25 is cyan emitter, having chromaticity coordinates 75*c* (red light is filtered while green and blue light passes). Moreover, filters that remove only one primary component can have significant overlap with similar filters that remove another single primary component. Thus, any colors within the additional color gamut can be produced with a higher radiant efficiency by using the additional within-gamut emitters, and not the gamut-defining emitters. The exact radiant efficiency of the emitters will depend upon the nature of the individual emitters, such as the spectrum of the white-emitting layer and the transmissivity of color filters used to select the colors of the additional emitters.

While it is important that the radiant efficiency of certain emitters and colors can be improved, this measure is not necessarily correlated with the efficiency of the display to produce useful light within an actual application as radiant efficiency does not consider the sensitivity of the human visual system to the light that is created. A more relevant measure is the luminous efficiency of the display when used to display a typical set of images. The luminous efficacy of the radiant energy is the quotient of the luminous power divided by the corresponding radiant power. That is the radiant power is weighted by the photopic luminous efficiency function $V(\lambda)$ as defined by the CIE to obtain luminous power. The term "luminous efficiency" is therefore defined as the luminous power emitted by the display, a group of emitters or an individual emitter divided by the electrical power consumed by the display, a group of emitters or an individual emitter.

Figure 2:
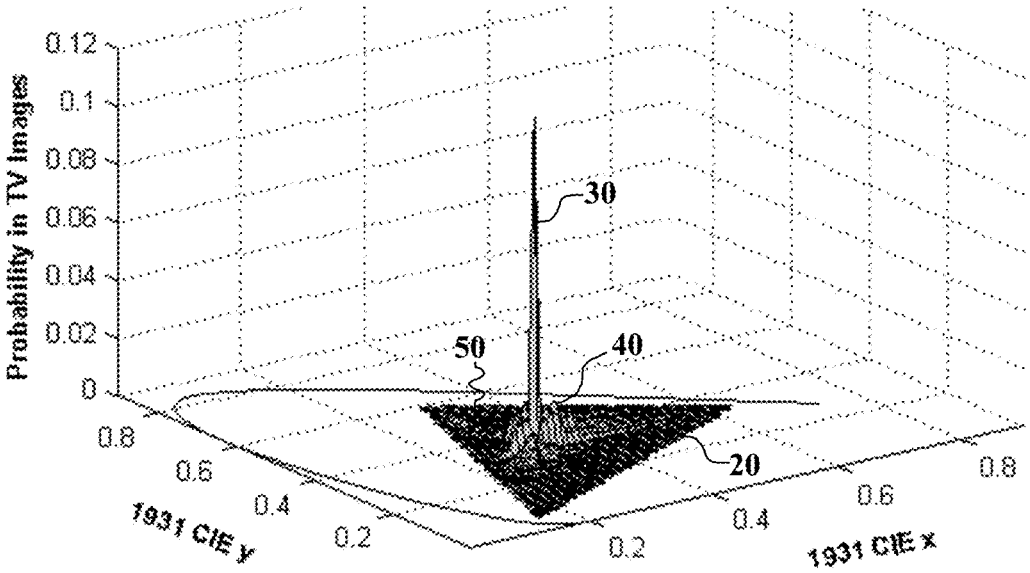
FIG. 2 shows the probability of a color being displayed in high-definition television images.

To assess the luminous efficiency of the resulting display, it is important to identify the types of images the display will be used to provide. To demonstrate the usefulness of the present invention, it is therefore useful to define a standard set of images against which to determine power consumption. Turning now to FIG. 2, there is shown the results of a study of colors' probabilities of being displayed in high-definition television images. To perform this assessment, a video defined by the IEC 62087 standard entitled "Methods of measurement for the power consumption of audio, video and related equipment (TA1)" was employed. This video is provided in DVD format and represents typical television images. To perform this analysis, this DVD was converted to approximately 19,000 digital images, these images representing frames of video. The probability of each RGB code value, in sRGB color space, within this image set was determined by summing the number of pixels having each RGB code value combination and dividing by the total number of pixels. For each RGB combination, the 1931 CIE x, y chromaticity coordinates were calculated as appropriate for code values represented in the sRGB color space. One feature of this color space is that it has a defined white point chromaticity corresponding to a daylight illuminant with a color temperature of 6500K. Note that any display has a defined "display white point" which corresponds to the chromaticity coordinates at which a true white color (often having input code values of 255, 255, and 255 for the red, green, and blue input color channels of an 8 bit display, respectively) will be rendered. The display will also have a display white point luminance, which is the luminance that is produced when a true white color is rendered on the display. Note that while the sRGB color space defines the display white point as equivalent to a daylight illuminant with a color temperature of 6500K or chromaticity coordinates of x=0.3128, y=0.3292, the display can define the white point chromaticity at other coordinates, even when displaying sRGB images. However, the display white point chromaticity will preferably fall on or near the blackbody or Planckian locus.

The 1931 chromaticity coordinates of the colors from the video are shown by the x- and y-axes of FIG. 2. The dark triangle represents the gamut of colors that can be produced by three gamut-defining emitters (red, green, and blue, or RGB, at the corners of the triangle) having primaries with chromaticity coordinates equal to the chromaticity coordinates defined in the HDTV standard Rec. 709 color space and from the Rec 709 gamut 20.

The z-axis in FIG. 2 represents the proportion of occurrence for each particular pair of coordinates compared to the total number of pixels analyzed, which is the number of display pixels multiplied by the number of images analyzed. Therefore, the z-axis represents the probability that a given pixel will be required to display a given color. Only a very small fraction of colors has a probability of being displayed more than 2% of the time, and these colors are shown by a sharp peak representing colors immediately surrounding the white point of the three-component input image signal. These will be referred to as high-probability colors 30. A larger range of colors has a probability of being displayed between 0.2% and 2% of the time. These will be referred to as medium-probability colors 40. Though broader than the sharp white peak of high-probability colors 30, medium-probability colors 40 also are clustered moderately closely to the white portion of the 1931 CIE color space. Finally, the vast majority of colors have probabilities of being displayed less than 0.2% of the time, and in many cases far less. These will be referred to as low-probability colors 50 and include many of the colors near the limits of the deliverable gamut of colors, including colors having the same chromaticity as the gamut-defining emitters themselves.

A comparison of FIG. 2 with FIG. 1 shows that the high-probability colors, and the majority of the medium-probability colors, can be produced by combinations of the additional emitters, often without employing the gamut-defining emitters. The gamut-defining emitters can be reserved generally for producing the low-probability colors. Further, even these colors can often be formed using a combination of gamut-defining and the additional emitters. Overall, this implies that a high percentage of the colors that the display is called upon to produce in a given period of time can be displayed with the higher-efficiency additional emitters. This will increase the overall efficiency of the display and reduce its power consumption. The reduction in power consumption will depend upon the fraction of medium- and high-probability colors within the additional color gamut and upon the efficiency of the additional emitters. There is naturally a trade-off, as increasing the color gamut of the additional emitters will typically reduce the radiant or luminance efficiency of the additional emitters but will permit a larger percentage of the colors to be formed by combining light from these additional emitters. Therefore, these two effects can move the luminance efficiency of the display in opposite directions. The most efficient emitter will be one that does not filter any light, e.g. a white emitter when the underlying light-emitting layers are white-light emitting. Such emitters, however, will not encompass much of the region of medium- and high-probability colors in FIG. 2. To encompass more colors within the additional gamut, emitters that are significantly different from the primary colors (red, green and blue) that form white, e.g. cyan, magenta, and yellow, should be selected. However, such emitters necessarily still absorb some of the white light and therefore reduce the efficiency of the emitters, and this efficiency reduction is greater for emitters that are farther in 1931 CIE color space from the chromaticity of the white-light-emitting layer. Thus, as one increases the size of additional color gamut 70, more colors can be produced by the additional color gamut, but the efficiency of the additional color gamut decreases. At some point for a given display, there will be a maximum power reduction that can be achieved by the use of the additional color gamut. Since most applications include displaying a preponderance of pixels with chromaticity that is relatively close to the display white point chromaticity as compared to the gamut-defining primaries, the additional gamut defined by the chromaticity coordinates of the additional emitters will typically have an area within the 1931 CIE chromaticity diagram that is less than or equal to 50% of the area of the gamut defined by the gamut-defining primaries within the same color space. That is, the display gamut and the additional color gamut will have respective areas in the 1931 CIE chromaticity color diagram and the area of the additional color gamut is equal to or less than half the area of the display gamut. In fact, when the additional gamut-defining primaries include typical dye or pigment based color filters, as are commonly used in the art, the additional gamut defined by the chromaticity coordinates of the additional emitters will typically have an area within the 1931 CIE chromaticity diagram that is less than or equal to 20% of the area of the gamut defined by the gamut-defining primaries, and in many preferred embodiments, the area of the additional gamut will be less than 10% of the area of the display gamut.

Figure 3A:
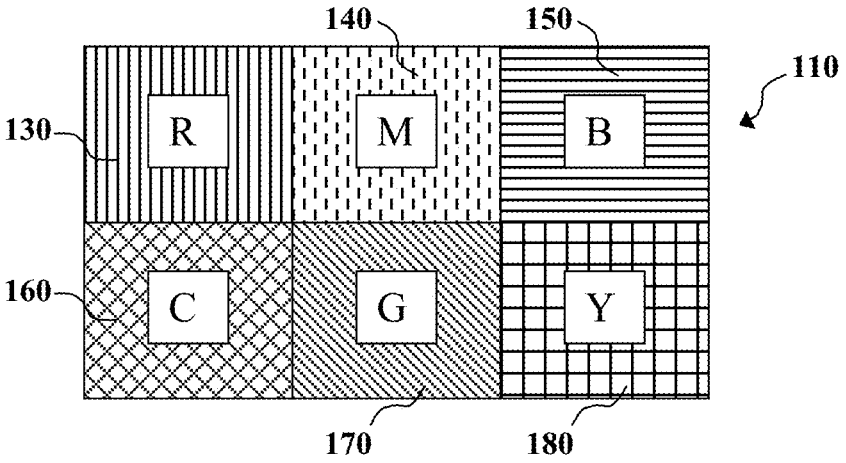
FIG. 3A shows a plan view of one basic embodiment of an arrangement of subpixels that can be used in this invention.

Turning now to FIG. 3A, there is shown a plan view of one basic embodiment of an arrangement of subpixels that can be used in this invention. Pixel 110 includes gamut-defining red, green, and blue emitters or subpixels 130, 170, and 150, respectively. Pixel 110 further includes additional cyan, magenta, and yellow emitters or subpixels 160, 140, and 180, respectively.

Figure 3B:
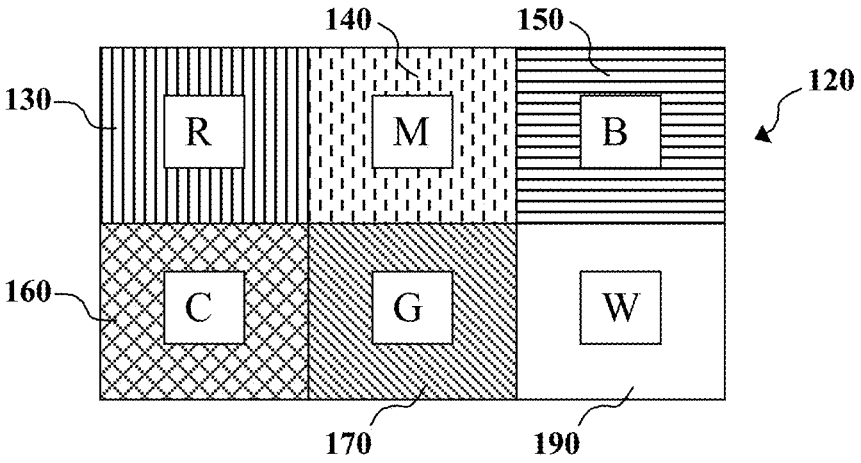
FIG. 3B shows a plan view of another basic embodiment of an arrangement of subpixels that can be used in this invention.
Figure 3C:
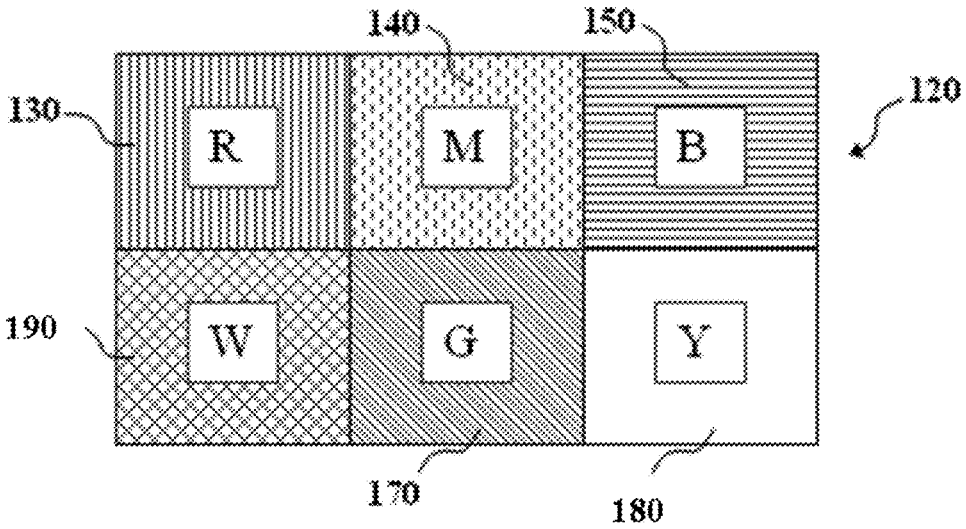
FIG. 3C shows a plan view of another basic embodiment of an arrangement of subpixels that can be used in this invention.

Turning now to FIG. 3B, there is shown a plan view of another basic embodiment of an arrangement of subpixels that can be used in this invention. Pixel 120 includes the same gamut-defining emitters or subpixels as pixel 110, above, and also includes additional cyan and magenta emitters or subpixels 160 and 140, respectively. In this embodiment, however, the third additional emitter is white emitter or subpixel 190. Although this will provide a smaller additional gamut in comparison to pixel 110, white emitter 190 can be produced simply by leaving the underlying white emitter unfiltered. Thus, pixel 120 represents a simpler manufacturing procedure for an OLED display in comparison to pixel 110. Further, the white emitter or subpixel 190 does not require a color filter, allowing the particular color of light produced by subpixel 190 to be produced with a very high radiant efficiency. Within particularly preferred embodiments, the chromaticity coordinates of the white emitter 190 and the chromaticity coordinates of the other additional emitters; for example the cyan and magenta emitters or subpixels 160 and 140 will create a color gamut that includes the chromaticity coordinates of the display white point and more preferably includes coordinates of common display white points, including daylight illuminants with correlated color temperatures between 6500K and 9000K. Therefore, in this embodiment, the white emitter 190 will therefore ideally have a yellow tint and will have an x coordinate equal to or greater than 0.3128 and a y coordinate equal to or greater than 0.3292. In an alternate embodiment, shown in FIG. 3C, the additional emitters can include magenta 140 and yellow 180 emitters together with an additional emitter 190 for emitting white light where in this embodiment, the color of the white emitter 190 is somewhat cyan of the chromaticity coordinates of the display white point and will preferably have an x chromaticity coordinate equal to or less than 0.2853 and a y chromaticity coordinate equal to or greater than 0.4152.

To provide an efficient display, the white-light emitting unit will preferably include at least three different light-emitting materials, each material having different spectral emission peak intensity. The term "peak" used here refers to a maximum in a function relating radiant intensity of the emitted visible energy to the spectral frequency at which the visible energy is emitted. These peaks can be local maxima within this function. For example, a typical white OLED emitter will often include at least a red, a green, and a blue dopant, and each of these will a produce local maximum (and therefore a peak) within the emission spectrum of the white emitter. Desirable white emitters can also include other dopants, such as a yellow, or can include two dopants, one a light blue and one a yellow, each producing a peak within the emission spectrum. The two or more color filters will each have a respective spectral transmission function, wherein this spectral transmission function relates the percent of radiant energy transmitted through the filter as a function of spectral frequency. It is desirable that that the spectral transmission of the two or more color filters is such that the percent of radiant energy transmitted by the color filters is 50% or greater at spectral frequencies corresponding to the peaks in the function relating radiant intensity to spectral frequency each different dopant within the white-emitting layer. In a preferred embodiment, the white-light emitting unit includes at least three different light-emitting materials each light-emitting material having a spectral emission that includes a peak in intensity at a unique peak spectral frequency and wherein the two or more color filters each have a spectral transmission function such that the spectral transmission of the two or more color filters is 50% or greater at spectral frequencies corresponding to the peak intensities of at least two of the light-emitting materials.

Figure 4:
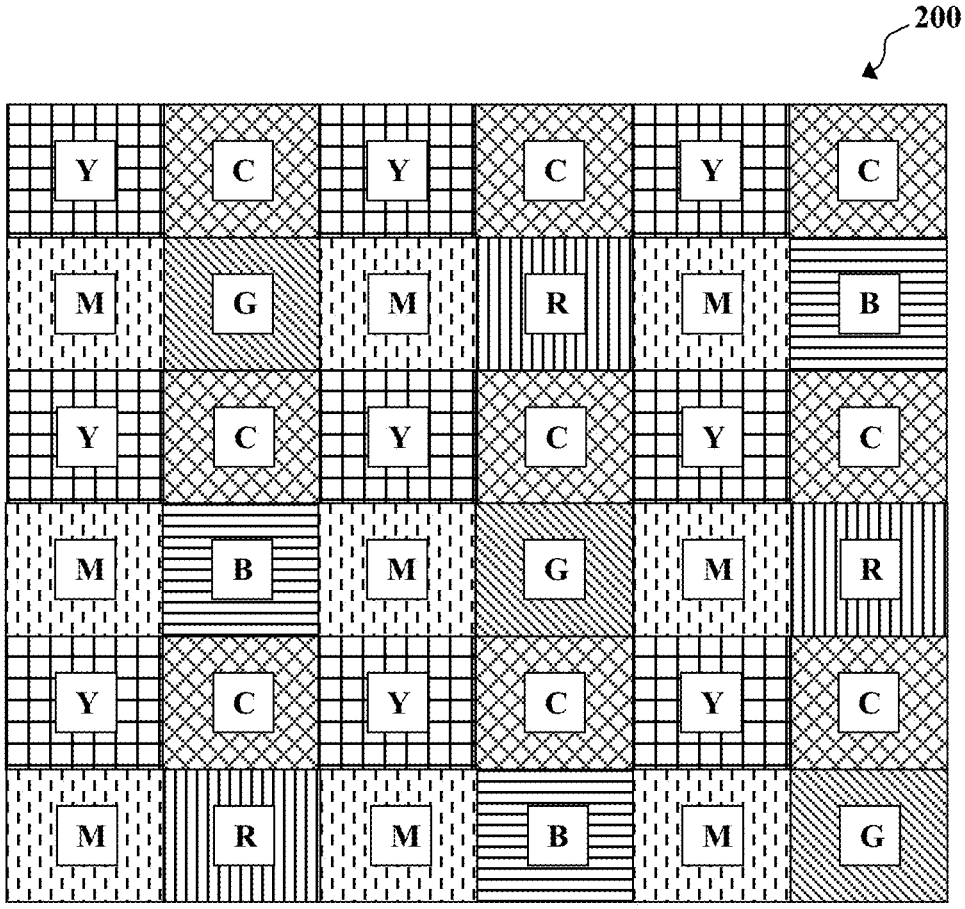
FIG. 4 shows a plan view of another embodiment of an arrangement of subpixels that can be used in this invention.

Turning now to FIG. 4, there is shown a plan view of another embodiment of an arrangement of subpixels that can be used in this invention with the advantage of balancing subpixel lifetime. OLED display 200 shows a matrix of red (R), green (G), blue (B), cyan (C), magenta (M), and yellow (Y) subpixels. There are three times as many CMY subpixels as RGB subpixels. This is because, as shown in FIG. 1 and FIG. 2, the cyan, magenta, and yellow subpixels can be used far more frequently in generating the colors required by the signal, e.g. a television transmission. As indicated earlier, a pixel refers to a minimum area of a display panel that includes a repeating array of subpixels and can display the full gamut of display colors. FIG. 4 is an example of an array in the display that is capable of displaying the full gamut of display colors where this entire array can be defined as a "pixel". However, this does not imply that a single pixel of data in an input image signal is mapped to this array, instead multiple pixels of input data can be mapped to this one display pixel using subpixel interpolation methods as are commonly employed in the art.

For the cases of colors outside of additional color gamut 70, one or more of the RGB subpixels will be used, which are inefficient. A first reason for the inefficiency, described above, is that the filters remove a significant quantity of the light produced by the underlying white emitter and therefore these emitters have a low radiant efficiency. A second reason, which is most true of the red and blue subpixels, has to do with human vision, which is less sensitive near the blue and red limits of vision. These subpixels will, therefore, not only have a low radiant efficiency as compared to an unfiltered white subpixel but they will have low luminance efficiency as compared to a white emitter even if the two had the same radiant efficiency. Therefore, it can be necessary to drive the gamut-defining subpixels, and especially the blue and red subpixels, to higher intensities to achieve an improved visual response. Thus, it can seem counterintuitive to have more CMY subpixels than RGB subpixels in OLED display 200. However, FIG. 2 shows that if the additional emitters (the CMY subpixels) can produce most of the high- and medium-probability colors, the gamut-defining pixels will be required to emit relatively infrequently. Because of this, it is possible to drive the gamut-defining pixels to higher intensities when needed, while only adding slightly to the display power requirements. Furthermore, driving the gamut-defining subpixels to higher intensities can reduce the effective lifetimes of the subpixels. However, the relatively infrequent use of these subpixels can actually increase their lifetimes in comparison to a display in which the RGB subpixels are the sole light producers. Thus, it can be possible to balance the effective lifetimes of fewer RGB subpixels with a greater number of CMY subpixels.

Figure 5A:
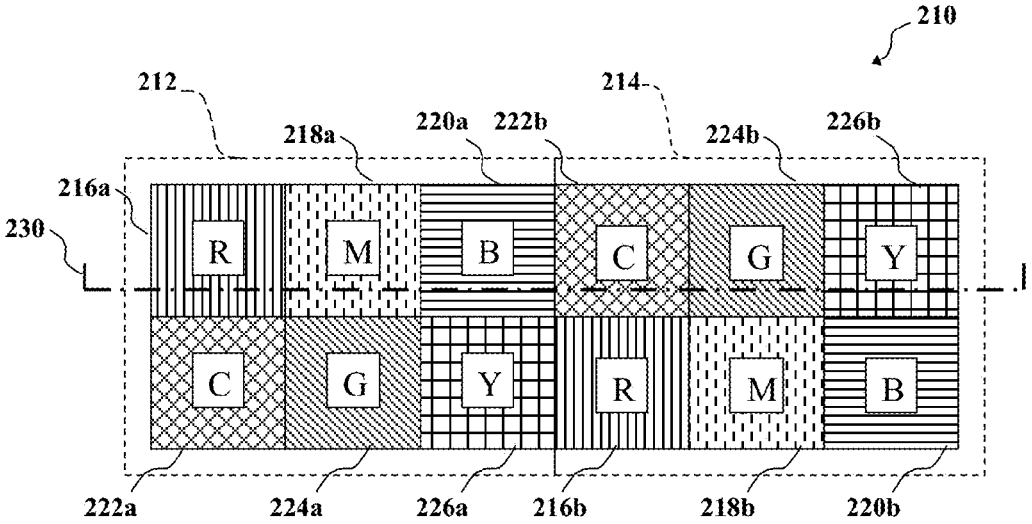
FIG. 5A shows a plan view of another embodiment of an arrangement of subpixels that can be used in this invention.

Turning now to FIG. 5A, there is shown a plan view of another embodiment of an arrangement of subpixels that can be used in this invention. This arrangement can form a pixel 210 within an OLED display useful in the present invention. As shown, the pixel 210 of FIG. 5A includes two portions 212 and 214. The first portion 212 is the same subpixel arrangement as shown in FIG. 3A, having red 216*a*, green 224*a*, and blue 220*a* gamut-defining subpixels as well as cyan 222*a*, magenta 218*a*, and yellow 226*a* additional subpixels. The second portion 214 includes similar red 216*b*, green 224*b*, and blue 220*b* gamut-defining subpixels as well as cyan 222*b*, magenta 218*b*, and yellow 226*b* additional subpixels, however, this second portion has been geometrically transformed such that the first and second rows of subpixels have been inverted. It will be obvious to one skilled in the art that any geometric transform, such as the one exemplified in the pixel of FIG. 5A can be performed to obtain other desirable arrangements of subpixels.

Figure 5B:
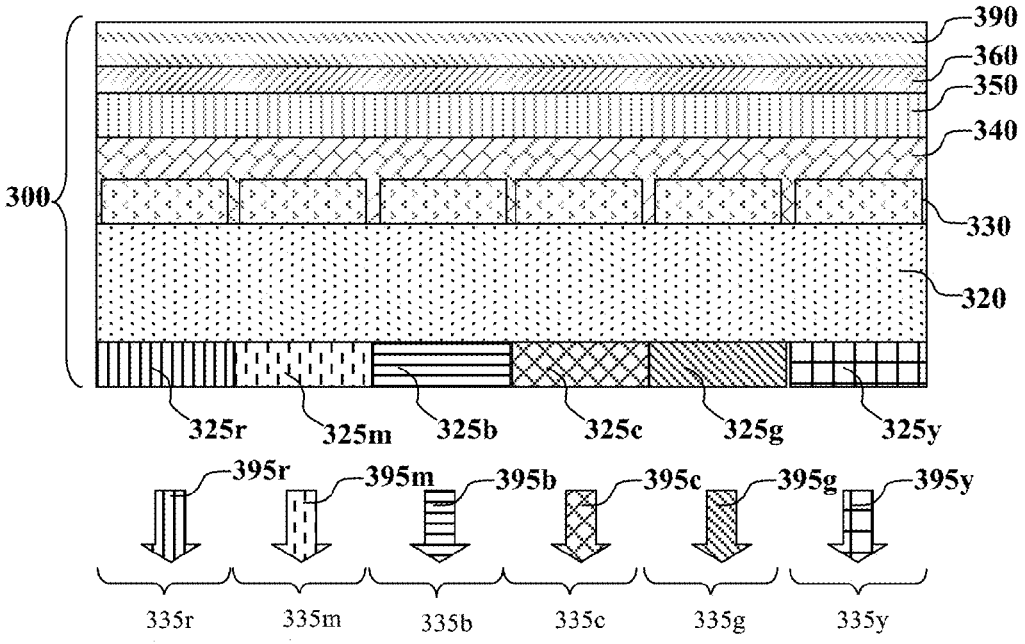
FIG. 5B shows a cross-sectional view of one embodiment of an OLED device that can be used in this invention.

Turning now to FIG. 5B, there is shown a cross-sectional view of one embodiment of an OLED device that can be used in this invention. FIG. 5B shows a cross-sectional view along the parting line 230 of FIG. 5A. OLED display 300 includes a series of anodes 330 disposed over substrate 320, and a cathode 390 spaced from anodes 330. At least one light-emitting layer 350 is disposed between anodes 330 and cathode 390. However, many different light-emitting layers or combinations of light-emitting layers as well-known to those skilled in the art can be used as white-light emitters in this invention. OLED device 300 further includes a hole-transporting layer 340 disposed between anodes 330 and the light-emitting layer(s), and an electron-transporting layer 360 disposed between cathode 390 and the light-emitting layer(s). OLED device 300 can further include other layers as well-known to those skilled in the art, such as a hole-injecting layer or an electron-injecting layer.

Each of the series of anodes 330 represents an individual control for a subpixel. Each of the subpixels includes a color filter: red color filter 325*r*, magenta color filter 325*m*, blue color filter 325*b*, cyan color filter 325*c*, green color filter 325*g*, and yellow color filter 325*y*. Each of the color filters acts to only let a portion of the broadband light generated by light-emitting layer 350 pass. Each subpixel is thus one of the gamut-defining RGB emitters or the additional CMY emitters. For example, red color filter 325*r* permits emitted red light 395*r* to pass. Similarly, each of the other color filters permit the respective emitted light to pass, e.g. magenta emitted light 395*m*, blue emitted light 395*b*, cyan emitted light 395*c*, green emitted light 395*g*, and yellow emitted light 395*y*. This invention requires three color filters corresponding to the red, green, and blue emitters, and two or more color filters corresponding to the three additional emitters. In this embodiment, each of the three additional emitters includes a color filter. In another embodiment, yellow filter 325*y* or cyan filter 325*c* can left out as discussed earlier. It should also be noted that the color filters 325*r*, 325*m*, 325*b*, 325*c*, 325*g*, 325*y* are shown on the opposite side of the substrate 320 from the light-emitting layer 350. In more typical devices, the color filters 325*r*, 325*m*, 325*b*, 325*c*, 325*g*, 325*y* are located on the same side of the substrate 320 as the light-emitting layer 350 and often either between the substrate 320 and the anode 330 or on top of the cathode 390. However, in OLED displays wherein the substrate 320 is thin compared to the smallest dimension of a pixel of the OLED display in a plan view, it is often desirable for the color filters 325*r*, 325*m*, 325*b*, 325*c*, 325*g*, 325*y* to be placed on the opposite side of the substrate 320 from the light-emitting layer 350 as shown in FIG. 5B.

Figure 5C:
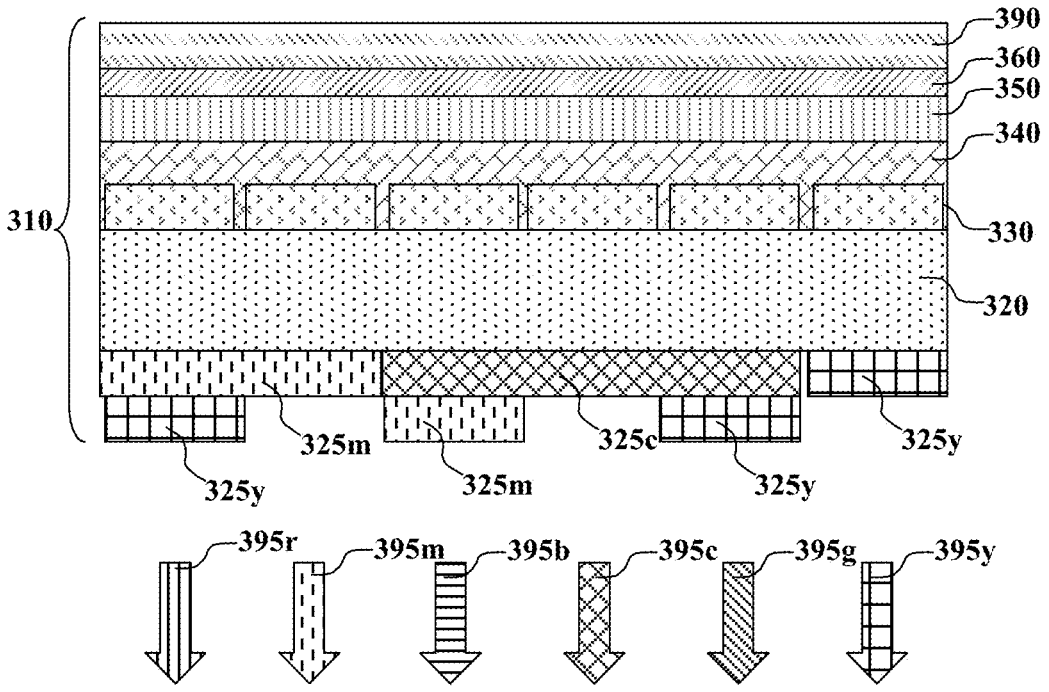
FIG. 5*c* shows a cross-sectional view of another embodiment of an OLED device that can be used in this invention.

Turning now to FIG. 5C, there is shown a cross-sectional view of another embodiment of an OLED device that can be used in this invention. OLED device 310 is similar to OLED device 300 of FIG. 5A, except that the color filters for the gamut-defining emitters are formed from combinations of the color filters of the additional emitters, e.g. cyan, magenta, and yellow, which are well-known as subtractive colors. In OLED device 310, emitted magenta, cyan, and yellow light 395*m*, 395*c*, and 395*y*, respectively, are formed using the respective magenta, cyan, and yellow filters 325*m*, 325*c*, and 325*y*. However, emitted red, green, and blue light is formed by combinations of these same filters. Thus, emitted red light 395*r* is formed using a combination of magenta and yellow color filters 325*m* and 325*y*, respectively. Similarly, emitted blue light 395*b* is formed using a combination of cyan and magenta filters, and emitted green light 395*g* is formed using a combination of cyan and yellow filters.

Figure 6:
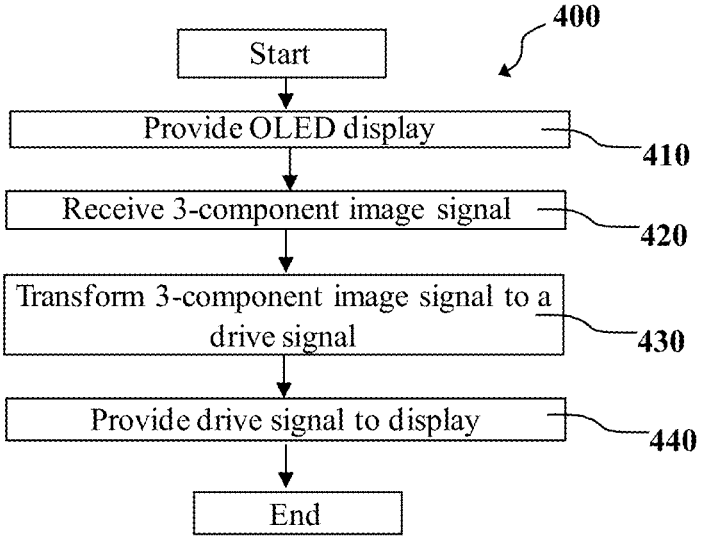
FIG. 6 shows a block diagram of the method of this invention.

Turning now to FIG. 6, and referring also to FIG. 1, there is shown a block diagram of the method 400 of this invention. For this discussion, it will be assumed that the additional emitters are cyan, magenta, and yellow, or CMY. It will be understood that this method can be applied to other combinations of additional emitters. An OLED display is provided (Step 410) that can include a white-light emitting layer 350 in FIG. 5B, three color filters 325*r*, 325*g*, 325*b* for emitting light corresponding to red, green and blue gamut-defining emitters, each emitter having respective chromaticity coordinates (e.g., 25*r*, 25*g*, 25*b* of FIG. 1), wherein the chromaticity coordinates of the gamut-defining emitters 335*r*, 335*g*, 335*b* in FIG. 5B define a display gamut (20 in FIG. 1), and two or more additional color filters 325*c*, 325*m*, 325*y* for filtering light corresponding to three additional within-gamut emitters 335*c*, 335*m*, 335*y* having chromaticity coordinates 75*c*, 75*m*, 75*y* within the display gamut 20 and wherein the chromaticity coordinates 75*c* 75*m*, 75*y* of the three additional emitters 335*c*, 335*m*, 335*y* form an additional display gamut 70. Each filtered emitter 335*r*, 335*g*, 335*b*, 335*c*, 335*m*, and 335*y* has a corresponding radiant efficiency. The radiant efficiency of each additional emitter 335*c*, 335*m*, and 335*y* is greater than the radiant efficiency of each of the gamut-defining emitters 335*r*, 335*g*, and 335*b*, as described above. A three-component (e.g. RGB) input image signal is received corresponding to a desired color and intensity to be displayed within the color gamut (Step 420). The three-component input image signal is transformed into a six-component drive signal (e.g. RGBCMY or RGBCMW) (Step 430). The six-component drive signal is then provided to the respective emitters of the OLED display (Step 440) to display an image corresponding to the input image signal whereby there is a reduction in power as compared to the power required to drive only the gamut-defining primaries to the same display white point luminance. Because many of the colors that the input image signal directs the display to provide can be generated by the more efficient additional emitters, this process will give a reduction in the power needed to drive the display.

Figure 7:
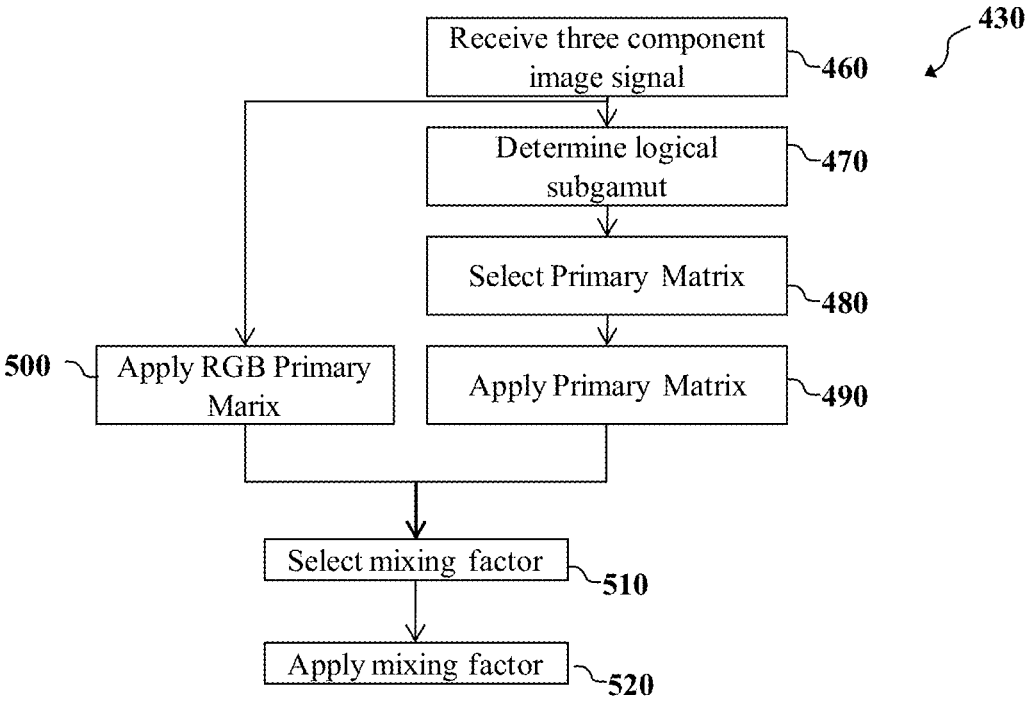
FIG. 7 shows a block diagram of a transformation of a standard three-component input image signal into a six-component drive signal.

Turning now to FIG. 7, there is shown in greater detail Step 430 of FIG. 6. Although this method can be used to convert the three-component input image signal to a six or more component drive signal, the same basic method can be used to convert the three-component input image signal to any five or more component drive signal. Referring again to FIG. 1, the color of the three-component input image signal for a given pixel can be within the additional gamut 70 or outside of it, but will typically be defined to be within the Rec. 709 color gamut 20. If the color of the three-component input image signal is within the additional gamut 70 (Step 450), the Cyan (C), Magenta (M), Yellow (Y) emitters can be used alone to form the desired color, and the intensities of the CMY emitters can be calculated from the Red (R), Green (G), Blue (B) signal (Step 460). The input signal is represented as a six-component value RGB000, meaning that there is no CMY component (the latter three parts) to the signal. The converted signal from Step 460 can be represented as 000CMY, meaning that the signal consist entirely of cyan, magenta, and yellow intensities.

It will be understood that there are many ways that the above three-component signal can be transformed into the six-component signal that drives the display. At one extreme, there can be a null transformation, so that the gamut-defining emitters alone are used to display the desired color, e.g. the initial value of RGB000. This transform can be performed regardless of the color indicated by the three-component input image signal. However, this method is inefficient and causes high power consumption.

At the other extreme, the colors can be transformed such that the colors will be formed by the most efficient primaries. Although this transform can be accomplished using a number of methods, in one useful method the color gamut of the display can be divided into multiple, non-overlapping logical subgamuts. These logical subgamuts are portions of the display gamut which are defined using chromaticity coordinates of combinations of three gamut-defining or additional emitters. These logical subgamuts include areas defined by the chromaticity coordinates of the CMY CMB, MYR, YCG, BRM, RGY, and GBC emitters within a display having RGBCMY emitters. Note that in displays having fewer emitters, the number of logical subgamuts will be reduced. To perform the conversion, the step 430 can be performed using the detailed process in FIG. 7. Step 430 includes receiving 460 the three-component input image signal. The three-component input image signal is analyzed to determine 470 which of the logical subgamuts the indicated color is located and the three-component input image signal is transformed into a combination of these three signals using a primary matrix corresponding to the chromaticity coordinates of the appropriate logical subgamut using methods as known in the art. This includes selecting a primary matrix 480 and applying 490 the inverse of this primary matrix to the three-component input image signal to obtain intensity values. When applying this method when the three-component input signal corresponds to a color having chromaticity coordinates within the additional gamut, this color is transformed and reproduced using the additional emitters, and in fact they are reproduced using only the additional emitters, resulting in a drive signal that includes 000CMY, where CMY are greater than zero. Therefore, three-component input image signals having colors within the additional gamut is reproduced with a very high efficiency. Further three-component input image signals corresponding to colors within the display gamut but outside the additional gamut are transformed and reproduced using combinations of the gamut-defining and additional emitters. For example, a blue color might be produced with 00BCM0, where BCM are greater than 0. Three-component input image signals inside the logical subgamut defined by the chromaticity coordinates of the CMB, MYR, or YCG emitters are reproduced using combinations of one of the gamut-defining and two of the additional emitters while the three-component input image signals inside the logical subgamut defined by the chromaticity coordinates of the BRM, RGY, and GBC emitters are reproduced using combinations of two of the gamut-defining and one of the additional emitters.

When applying this method intensity values are provided for no more than three of the emitters to form any color and therefore half of the subpixels will be dark. This can lead to the appearance of greater pixilation on the OLED display to the viewer. Therefore, in some cases it can be desirable to employ a larger number of the subpixels when forming a color. This is particularly true when the color has a high luminance. In this situation, it is possible to compute a transform using the gamut-defining primaries, for example by applying 500 the inverse primary matrix for the gamut defining primaries and then apply 520 a mixing factor that creates a blended signal for driving the emitters of the display, which can be represented as R'G'B'C'M'Y'. This blended signal is basically a weighted average of the signals output from steps 490 and 500. One skilled in the art can select 510 the RGB-to-logical subgamut mixing factor based on the desired trade-off of power consumption and image quality. This mixing factor can also be selected 510 based upon the three-component input image signal or a parameter calculated from the three-component input image signal, such as luminance or the strength of edges within a spatial region of the three-component input image signal. This mixing signal will be a value between 0 and 1 and will be multiplied by the signals resulting from step 500 and then added to the multiplicand of one minus the mixing factor and the signals resulting from step 490. Once this mixing factor is selected and applied, the conversion process is completed.

Although shown as a decision tree, it will be understood that Step 430 can be implemented in other ways, e.g. as a lookup table. In another embodiment, Step 430 can be implemented in an algorithm that calculates the intensity of the input color in each of the seven non-overlapping logical subgamuts, and the matrix with positive intensities is applied. This will provide the lowest power consumption choice. In this case, one can choose to apply a mixing factor with complete color gamut 20 or one or more of the remaining logical subgamuts, with a trade-off of slightly higher power consumption, if other characteristics are desirable, e.g. improved lifetime of the emitters in the display or improved image quality.

In an OLED display useful in the method of the present invention, the emitters are often provided power from power busses. Typically, the busses connect the emitters to a common power supply having a common voltage and therefore are capable of providing a common peak current and power. This is not strictly necessary when using additional emitters and in some embodiments, it is beneficial to provide power to the additional emitters through a separate power supply, having a lower bulk voltage (defined below) and peak power than is provided to the gamut-defining emitters.

It should be noted that in these displays, a fixed voltage will typically be provided to either the cathode or anode of the subpixels within an OLED display while the voltage on the other of the cathode or anode will be varied to create an electrical potential across the OLED to promote the flow of current, resulting in light emission. Within active matrix OLED displays, the variable current is provided by an active circuit, e.g. including thin film transistors for modulating current from a power supply line to the OLED when the fixed voltage is provided to the other side of the OLED from a distributed conductive layer. This power supply line will be provided a constant voltage and therefore the bulk voltage is defined as the difference between the voltage provided on the distributed conductive layer and the voltage provided by the power supply line. By assigning different voltages to the power supply line or the conductive layer, the magnitude (absolute value) of the bulk voltage, and thus the magnitude of the maximum voltage across the OLED emitter can be adjusted to adjust the peak luminance that any OLED emitter connected to the power supply line can produce. This magnitude is relevant whether the power line is connected to the anode or the cathode of the OLED emitter (i.e. it can be calculated for inverted, non-inverted, PMOS, NMOS, and any other drive configuration).

In this embodiment, the power to the additional emitters is reduced by having both a lower voltage and reduced current. As such the method of the present invention will further include providing power to the emitters, wherein the power is provided with a first bulk voltage magnitude to the gamut-defining emitters and with a second bulk voltage magnitude to the additional emitters, wherein the first bulk voltage magnitude is greater than the second bulk voltage magnitude. In this configuration, the EL display will typically have power busses deposited on the substrate, the first voltage level will be provided on a first array of power busses, and the second voltage level will be provided on a second array of power busses. The gamut-defining emitters will be connected to the first array of power busses and the additional emitters will be connected to the second array of power busses. The bulk voltage magnitude, the absolute difference in voltage between the power busses and a reference electrode, is preferably greater for the first array of power busses than the second array of power busses.

In another embodiment, each of the emitters (i.e., gamut-defining and additional emitters) is attached to the same power supply, so the display is capable of providing the same electrical power to each emitter, regardless of the efficiency of the emitter. The OLED display of the present invention is driven to use its full power range, so colors produced by the additional emitters can have a significantly higher luminance than can be produced using only the gamut-defining emitters. When applying a voltage to each of the three additional emitters during a first time period and applying the same voltage to each of the three gamut-defining emitters during a second time period, the luminance produced in the first time period is preferably at least twice as high as the luminance produced in the second time period, and more preferably at least four times higher than the luminance produced in the second time period. In this embodiment, the six components of the drive signal are preferably provided to the display such that at least one of the three-component input image signals is reproduced on the display with a first luminance value that is higher than the sum of the respective luminance values obtained by reproducing each of the three components of the input image signal on the display. To achieve this, it is desirable to provide the six components of the drive signal to respective emitters of the OLED display such that input signals corresponding to chromaticity coordinates of secondary colors are reproduced on the display with a first luminance value and two primary colors corresponding to the input signals of the secondary colors have second and third luminance values and wherein the first luminance value is greater than the sum of the second and third luminance values. Further, it is desirable to provide the six components of the drive signal to respective emitters of the OLED display such that input signals corresponding to chromaticity coordinates of colors within the additional color gamut are reproduced on the display with a first luminance value and three primary colors corresponding to the input signals of the color within the additional color gamut have second, third and fourth luminance values and wherein the first luminance value is greater than the sum of the second, third and fourth luminance values. Each of these rendering methods can be performed using multiple methods, however, to avoid desaturating images displayed on the EL display, it is desirable to adjust the display white point luminance of the display when rendering or reproducing any displayed image based upon the content of the image such that images requiring a large number of the gamut defining primaries to be used at high intensity levels are reproduced at relatively lower display white point luminance values than images requiring few gamut defining primaries to be used at high intensity levels.

Figure 8:
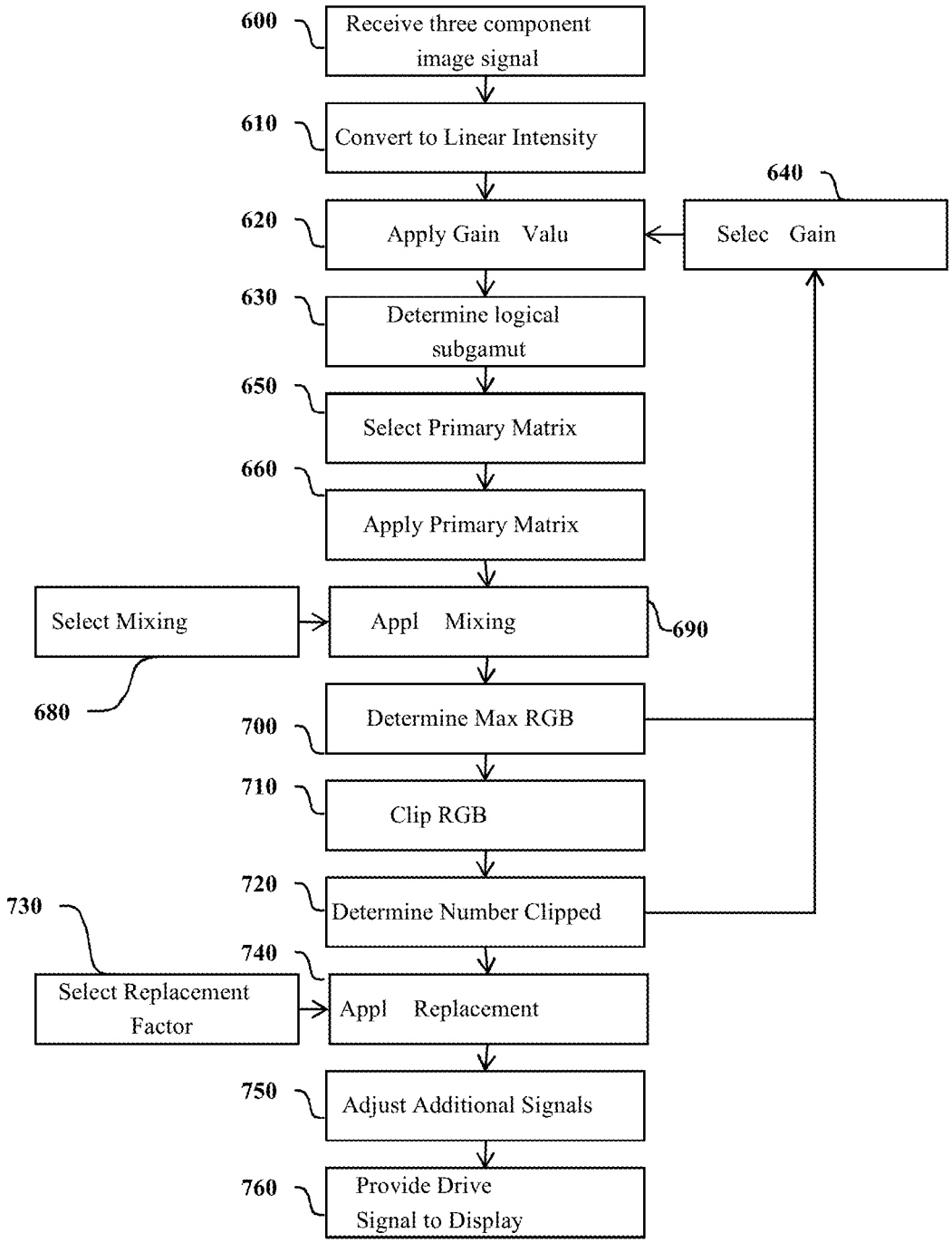
FIG. 8 shows a block diagram of a transformation of a standard three-component input image signal into a six-component drive signal.

A specific method for adjusting the peak luminance of the displayed image depending upon the use of the gamut defining primaries is provided in FIG. 8. This general method can be applied when converting any three-component input image signal to any five-or-more-component drive signal. As shown in this figure, the method includes receiving 600 the three-component input image signal and converting 610 the three-component input image signal to linear intensity values. This conversion is well known in the art and typically includes performing a nonlinear transformation to convert three-component input image signals which are typically encoded in a nonlinear space to a space that is linear with the desired luminance of the colors to be displayed. This conversion also typically includes a color space rotation to convert the input image signal to the gamut-defining primaries of the display. This conversion will typically provide this conversion such that white, when formed from a combination of the gamut-defining primaries, is assigned a linear intensity value of 1.0 and black is assigned a linear intensity value of 0. A gain value is then selected 640. For the initial image, this gain value might be unity; however, as will be discussed further, this gain value is selected to adjust the display white point luminance to values higher than can be produced using any combination of the gamut-defining primaries. This gain value is then applied 620 to the linear intensity values.

As in the method depicted in FIG. 7, the logical subgamut in which the specified color resides is then determined 630. A primary matrix is selected 650 as described previously and applied in step 660 to the gained linear intensity values. This step converts the original signal to a three-color signal using the three most efficient emitters. A mixing factor is then selected 680. This mixing factor is applied 690 to mix the original gained linear intensity values obtained from step 620 with the most efficient emitter values obtained from step 660. Any emitters not assigned a value is then assigned a value of zero. The maximum value assigned to the gamut-defining (i.e., RGB) emitters is then determined in step 700. If any of these values are greater than 1.0, the values are clipped (710) to 1.0 and the number of clipped values is determined (720). The process of clipping values (710) can result in undesirable color artifacts. Therefore, it is often useful to select a replacement factor 730. This replacement factor corresponds to the portion of the luminance that is lost due to clipping, which is to be replaced by luminance from one or more of the additional emitters. This replacement factor is then applied (740) to determine the intensity to be added to the additional emitters to replace the portion that is clipped (720). This includes, subtracting the clipped values obtained from step 710 from the gamut defining emitter values obtained from step 690, then applying the selected 730 replacement factor to this value and finally applying selected proportions of the secondary emitters to replace the luminance of the clipped gamut-defining emitter value. The signals for the additional emitters are then adjusted (750) by adding the values determined in step 740 to the additional emitter values determined in step 690 to produce a drive signal. Finally, the resulting drive signal is provided (760) to the display. When the next image is to be displayed, it is then necessary to select (640) a new gain value. To perform this selection, statistics, such as the maximum gamut-defining emitter value obtained from step 700 and the number of clipped gamut-defining emitter values can be used in this selection process. For example, if the maximum gamut-defining emitter value is significantly less than 1.0, a higher gain value can be selected. However, if a large number of values are clipped during step 710, a lower gain value can be selected. The adjustment of the gain value can occur either rapidly or slowly. It has been observed that rapid or large changes in gain value are desirable when the preceding image is the first image in a scene of a video but slower or small changes in gain value are desirable when a single scene is displayed. When rapid or large changes in gain value are desired, the adjustment can be obtained by normalizing the largest possible intensity value (e.g., 1.0) with largest intensity value in an image. Appropriate slower or small changes in gain are often on the order of 1 to 2 percent changes in intensity values per video frame in a 30 fps video. As described, the method depicted within FIG. 8 includes transforming the three-component input image signals such that the luminance of the display is adjusted based upon the content of the three-component input image signal.

Figure 9:
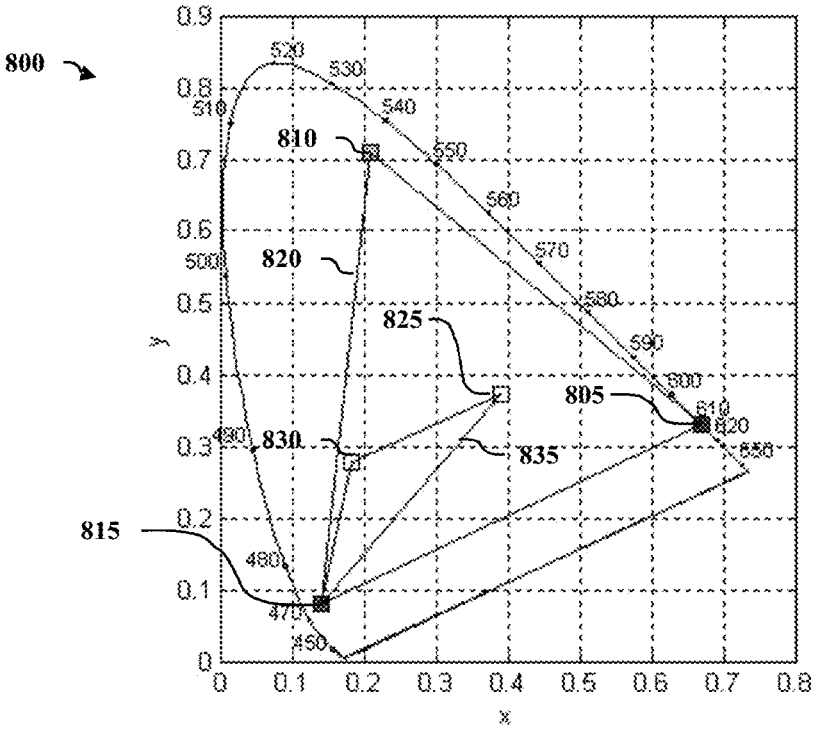
FIG. 9 shows a chromaticity diagram for a display having five emitters.
Figure 10:
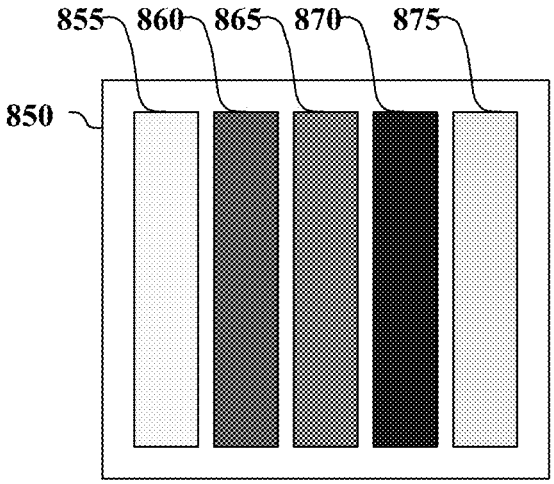
FIG. 10 shows a plan view of a portion of a display having three gamut-defining and two additional emitters.

It will be understood by one skilled in the art that while the method depicted in FIG. 8 will permit the transformation of the three-component input image signal to a six component image signal for driving the display, the same method can be applied for converting a three-component input image signal to a five-component image signal for driving the display. The primary difference between converting to a five component image signal and a six component image signal is that there is one less possible subgamut for the five component image signal condition as a subgamut cannot be formed by applying only the within-gamut emitters. As such, the method for displaying an image on a color display as shown in FIG. 6, including the more specific steps of FIG. 8 includes providing a color display (Step 410 in FIG. 6), a portion 850 of which is shown in FIG. 10, having a selected display white point luminance and chromaticity. This color display includes three gamut-defining emitters, for example red 860, green 865, and blue 875 emitters. The chromaticity of these emitters is shown in the chromaticity diagram 800 of FIG. 9 as red chromaticity 805, green chromaticity 810 and blue chromaticity 815. These chromaticity coordinates define a display gamut 820. The display further includes two or more additional emitters, including a first additional emitter 855 and a second additional emitter 875, as shown in FIG. 10. These two or more additional emitters 855 and 875 emit light at respective different chromaticity coordinates 825 and 830 in FIG. 9 within the display gamut 820. Each emitter 855, 860, 865, 870, 875 has a corresponding peak luminance and chromaticity coordinates. The gamut-defining emitters 805, 810, 815 produce a gamut-defining peak luminance at the target display white point chromaticity, and the gamut-defining peak luminance is less than the display white point luminance. That is, when the gamut-defining emitters 860, 865, 870 are applied to create a chromaticity equivalent to the display white point chromaticity, the resulting luminance will be less than the display white point luminance. A three-component input image signal is then received (step 420 in FIG. 6), which corresponds to a chromaticity within a supplemental gamut, for example subgamut 835 shown in FIG. 9, defined by a combination of light from three emitters that includes at least one of the additional emitters 855 and 875. The three-component input image signal is then converted to a five-component drive signal, step 430 in FIG. 6, such that when the transformed image signal is reproduced on the display, its reproduced luminance value is higher than the sum of the respective luminance values of the three components of the input signal when reproduced on the display with the gamut-defining emitters 860, 865, 870. Finally, the five-component drive signal is provided (step 440 of FIG. 6) to respective gamut-defining 860, 865, 870 and additional emitters 855, 875 of the display to display an image corresponding to the input image signal. Notice that this method requires that at least two combinations of emitters are present, which can be used to produce the display white point chromaticity. These two combinations include the gamut-defining emitters 860, 865, 870 and at least one additional emitter (e.g., 870) which can be combined with two or fewer of the gamut-defining emitters (e.g., 855, 875) to produce the chromaticity of the display white point (0.3, 0.3 in this example). Further, the display white point luminance that can be produced using the additional emitter will be greater than the display white point luminance that can be produced using only the gamut-defining emitters. This is achieved by providing additional emitters 855, 875 within the gamut 820 of the display that has significantly higher radiant efficiencies than the gamut-defining primaries 860, 865, 870.

Referring again to FIG. 10, power to the gamut-defining emitters 860, 865, and 870 is provided by a first array of power buses 890 having a first bulk voltage magnitude. Power to the two or more additional emitters (855 and 875 in FIG. 10) is provided by a second array of power buses 895 having a second bulk voltage magnitude.

Within this method, the display white point luminance for three-component input image signal is selected based upon the three-component input image signal, and more specifically based upon the saturation and brightness of colors within the three-component input image signal.

More specifically, when a three-component input signal is received which represents an image without bright, fully saturated colors, the luminance of the colors within the second combination of emitters will be higher than when a three-component input signal is input representing an image containing bright fully saturated colors. Further, this difference in luminance can be dependent upon the number of pixels having the fully saturated colors, such that images the colors within the second combination of colors will be lower when 10% of the pixels provide bright, fully saturated colors than when less than 1% of the pixels provide bright, fully saturated colors as a large number of pixels would be clipped if the gain value was large when displaying an image containing 10% or more pixels that are bright and fully saturated. This can be obtained by transforming (step 430 of FIG. 6) using the method as shown in FIG. 8 as described in detail earlier. As discussed earlier, the display white point luminance is selected by selecting 640 a gain value. This gain value is selected such that the number of gained values that are clipped is maintained within an allowable limit. The drive signals for specific pixels that are clipped are adjusted by applying a replacement factor 740, such that luminance artifacts are not objectionable.

To illustrate the benefit of the present method, power consumption was determined for four separate displays. This included a first display (Display 1) having only gamut-defining primaries, a second display (Display 2) having a single unfiltered, white-light emitter in addition to the gamut defining primaries. A third display (Display 3) having three gamut-defining emitters as well as three additional emitters was included, with one emitter unfiltered and the remaining two emitters formed to include cyan and magenta color filters. Display 3 is similar to Display 2, except it includes more filtered additional emitters. A fourth display (Display 4) was also included which further included a yellow color filtered over the unfiltered additional emitter of Display 3 and a different magenta filter than Display 3. Each of these displays had the same gamut-defining primaries and was identical except for the number of additional primaries. The additional color filters were commonly available color filters that were not optimized for this application in any way. The x, y chromaticity coordinates for the red, green, and blue gamut defining emitters were 0.665, 0.331; 0.204, 0.704; and 0.139, 0.057, respectively. The area of the gamut defined by these gamut-defining emitters within 1931 CIE chromaticity diagram is 0.1613. The white emitter was formed to include four light-emitting materials within the white-emitting layer.

Table 1 shows chromaticity coordinates (x,y) for each of the additional emitters (E1, E2, E3) in the four displays and the area of the display gamut and the additional color gamut. As shown, the additional gamut of Display 3 has an area that is about 4.6% of the area of the display gamut and the additional gamut of Display 4 has an area that is about 7.7% of the area of the display gamut. As such, the additional gamut of each of the displays defined according to the present invention is significantly less than 10% of the display gamut.

TABLE 1

CIEx, y Coordinates for Model Displays

| Display | E1, x | E1, y | E2, x | E2, y | E3, x | E3, y | Additional Gamut Area |
|---|---|---|---|---|---|---|---|
| 1 | N/A | N/A | N/A | N/A | N/A | N/A | N/A |
| 2 | 0.326 | 0.346 | N/A | N/A | N/A | N/A | N/A |
| 3 | 0.184 | 0.278 | 0.252 | 0.207 | 0.326 | 0.346 | 0.0074 |
| 4 | 0.184 | 0.278 | 0.351 | 0.235 | 0.390 | 0.373 | 0.0124 |

Table 2 shows average power consumption for the displays of this example, assuming each emitter has the same drive voltage and the method provided in FIG. 7 is used to convert the three-component input image signal to the six-component drive signal, fully utilizing the most efficient emitters. Also shown is the power for displays 2 through 4 divided by the power for display 1 when the display white point is at D65. Although the color filters on the additional emitters were not fully optimized in this example, each of them demonstrate a large performance advantage over the display having only gamut-defining primaries and at least some improvement over the display having one additional unfiltered emitter.

TABLE 2

Average Power Consumption for Model Displays (white = D65)

| Display | Power (mW) | Percent Power Reduction |
|---|---|---|
| 1 (comparative) | 15,100 | 0.0 |
| 2 (comparative) | 4,820 | 68.1% |
| 3 (invention) | 4,290 | 71.6% |
| 4 (invention) | 4,790 | 68.3% |

In the example of Table 2, the color of the white emitter used in Display 2 was designed to be nearly optimal when the display had a white point of D65. In most televisions, it is typical that the user is provided control over the white point setting, and the display is capable of providing lower power consumption when the white point of the display is changed. Table 3, shows the same information as Table 2, only assuming a display white point corresponding to a point on the daylight curve with a color temperature of 10,000 K. As shown, the power savings provided by the use of the three additional emitters is substantially larger in this example even when compared to the display having a single white emitter in addition to the three gamut-defining emitters. Therefore, the method of the present invention provides a very substantial power advantage over a comparable display having only three gamut-defining emitters and a substantial power advantage over comparable displays having fewer additional, in-gamut emitters.

TABLE 3

Average Power Consumption for Model Displays (white = 10K)

| Display | Power (mW) | Percent Power Reduction |
|---|---|---|
| 1 (comparative) | 16,000 | 0.0 |
| 2 (comparative) | 5,670 | 64.6% |
| 3 (invention) | 4,290 | 73.2% |
| 4 (invention) | 4,950 | 69.1% |

The invention has been described in detail with particular reference to certain preferred embodiments thereof, but it will be understood that variations and modifications can be effected within the spirit and scope of the invention.

PARTS LIST

20 Rec. 709 color gamut
25*r* chromaticity coordinates of red gamut-defining emitter
25*g* chromaticity coordinates of green gamut-defining emitter
25*b* chromaticity coordinates of blue gamut-defining emitter
30 high-probability colors
40 medium probability colors
50 low probability colors
60 NTSC color gamut
70 additional color gamut
75*c* chromaticity coordinates of cyan within-gamut emitter
75*m* chromaticity coordinates of magenta within-gamut emitter
75*y* chromaticity coordinates of yellow within-gamut emitter
110 pixel
120 pixel
130 red emitter (subpixel)
140 magenta emitter (subpixel)
150 blue emitter (subpixel)
160 cyan emitter (subpixel)
170 green emitter (subpixel)
180 yellow emitter (subpixel)
190 white emitter (subpixel)
200 OLED display
210 pixel
212 first portion
214 second portion
216*a* red subpixel
216*b* red subpixel
218*a* magenta additional subpixel
218*b* magenta additional subpixel
220*a* blue subpixel
220*b* blue subpixel
222*a* cyan additional subpixel
222*b* cyan additional subpixel
224*a* green subpixel
224*b* green subpixel
226*a* yellow additional subpixel
226*b* yellow additional subpixel
230 parting line
300 OLED display
310 OLED display
320 substrate
325*r* red color filter
325*m* magenta color filter
325*b* blue color filter
325*c* cyan color filter
325*g* green color filter
325*y* yellow color filter
330 anode
335*r* red gamut-defining emitter
335*m* magenta additional emitter
335*b* blue gamut-defining emitter
335*c* cyan additional emitter
335*g* green gamut-defining emitter
335*y* yellow additional emitter
340 hole-transporting layer
350 light-emitting layer
360 electron-transporting layer
390 cathode
395*r* emitted red light
395*m* emitted magenta light
395*b* emitted blue light
395*c* emitted cyan light
395*g* emitted green light
395*y* emitted yellow light
400 method
410 provide display step
420 receive three-component input image signal step
430 transform to drive signal step
440 provide drive signal step
460 calculate step
470 analyze image signal step
480 select primary matrix step
490 apply primary matrix step
500 apply gamut-defining matrix step
510 select mixing factor step

520 apply mixing factor step
600 receive three-component input image signal step
610 convert to linear intensity step
620 apply gain value step
630 determine logical subgamut step
640 select gain value step
650 select primary matrix step
660 apply primary matrix step
680 select mixing factor step
690 apply mixing factor step
700 determine maximum value step
710 clip step
720 determine number clipped step
730 select replacement factor step
740 apply replacement factor step
750 adjust additional signals step
760 provide drive signal step
800 CIE Chromaticity Diagram
805 red emitter chromaticity
810 green emitter chromaticity
815 blue emitter chromaticity
820 display gamut
825 first additional emitter
830 second additional emitter
835 subgamut
840 display portion
855 first additional emitter
860 red emitter
865 green emitter
870 blue emitter
875 second additional emitter

The invention claimed is:

1. A method for displaying an image on a color display, the color display to display an image including, for each of a plurality of pixels, three gamut-defining emitters that provide light of a predetermined color and define a display gamut and three additional emitters that emit light at a chromaticity different from one another and define an additional gamut within the display gamut, wherein seven non-overlapping logical subgamuts are defined by permutations of the three gamut-defining emitters and the three additional emitters, the method comprising for each pixel:

a) receiving a three-component input image signal;
b) defining a first primary matrix based on the chromaticity coordinates of the three gamut-defining emitters;
c) selecting one of the seven logical non-overlapping subgamuts in which the three-component input image signal is located;
d) defining a second primary matrix based on the chromaticity coordinates of the emitters of the selected logical subgamut;
e) applying the first primary matrix to the three-component input image signal to produce a first transformed drive signal;
f) applying the second primary matrix to the three-component input image signal to produce a second transformed drive signal;
g) selecting a mixing factor based on a desired trade-off of power consumption and image quality;
h) applying the mixing factor to the first transformed drive signal and the second transformed drive signal to produce a pixel drive signal; and
i) providing the pixel drive signal to the respective emitters to display an image corresponding to the input image signal whereby there is a reduction in power.

2. The method of claim 1, wherein the three additional emitters respectively emit cyan, magenta and yellow light.

3. The method of claim 1, wherein one of the three additional emitters emits white light.

4. The method of claim 1, wherein the display gamut and the additional gamut have respective areas in a 1931 CIE chromaticity color diagram and the area of the additional gamut is equal to or less than half the area of the display gamut.

* * * * *